US005532707A

United States Patent [19]

Klinger et al.

[11] Patent Number: 5,532,707

[45] Date of Patent: Jul. 2, 1996

[54] DIRECTIONAL ANTENNA, IN PARTICULAR DIPOLE ANTENNA

[75] Inventors: Georg Klinger, Saaldorf; Max Gottl, Grobkarollnenfeld, both of Germany

[73] Assignee: Kathrein-Werke KG, Rosenheim, Germany

[21] Appl. No.: 302,834

[22] PCT Filed: Feb. 1, 1994

[86] PCT No.: PCT/EP94/00285

§ 371 Date: Sep. 16, 1994

§ 102(e) Date: Sep. 16, 1994

[87] PCT Pub. No.: WO94/18719

PCT Pub. Date: Aug. 18, 1994

[30] Foreign Application Priority Data

Feb. 2, 1993 [DE] Germany ..... 43 02 905.1

[51] Int. Cl.[6] ..... H01Q 9/16

[52] U.S. Cl. ..... 343/793; 343/795; 343/805; 343/872

[58] Field of Search ..... 343/793, 795, 343/797, 805, 810, 815, 818, 821, 872; 29/600; H01Q 9/16, 9/28, 21/26

[56] References Cited

U.S. PATENT DOCUMENTS

| | | | |
|---|---|---|---|
| 2,430,353 | 11/1947 | Masters | 343/795 |
| 5,166,697 | 11/1992 | Viladevall et al. | 343/727 |
| 5,229,782 | 7/1993 | Hemmie et al. | 343/795 |

FOREIGN PATENT DOCUMENTS

| | | | |
|---|---|---|---|
| 0025654 | 2/1979 | Japan | 343/795 |
| 406029704A | 2/1994 | Japan | 343/795 |

*Primary Examiner*—Donald T. Hajec
*Assistant Examiner*—Tan Ho
*Attorney, Agent, or Firm*—Nixon & Vanderhye

[57] ABSTRACT

In order to create a directional antenna, in particular a dipole antenna, that is improved over the prior art, can be produced and is designed comparatively simply, and furthermore has further improved electrical properties, it is provided that the symmetrizer (7) is made from the material of the reflector (5), in that the symmetrizer (7) is cut from the remaining material of the reflector wall (5), except for a connecting segment (11), by suitable cuts and/or stamping operations, and preferably in the region of the immediate connecting point (11) with the remaining material of the reflector wall (5) is bent out relative to the plane of the reflector wall.

16 Claims, 5 Drawing Sheets

DIRECTIONAL ANTENNA, IN PARTICULAR DIPOLE ANTENNA

The invention relates to a directional antenna, in particular a dipole antenna, as generically defined by the preamble to claim 1.

Dipole antennas are often used as directional antennas to which there is a symmetrical power supply. In principle, this involves a symmetrical linear antenna that is horizontal or vertical, depending on the polarization of the electromagnetic waves, to which power is supplied in the middle. With dipoles offset by 90° from one another, in the final analysis, even a circularly polarized electromagnetic wave can be generated.

The directional antenna, comprising one or more dipole antennas, typically includes one or more radiators, which substantially comprise the two dipole halves and the so-called symmetrizer loop, above which the dipole, typically comprising the two rod halves, is oriented offset, with a preliminary offset toward the reflector wall carrying it, but is oriented essentially parallel to it but also angularly thereto.

A directional antenna according to the prior art, formed from a dipole antenna, or dipole field for short, will be described with reference to FIGS. 10*a*–10*c*.

Figure 10A:
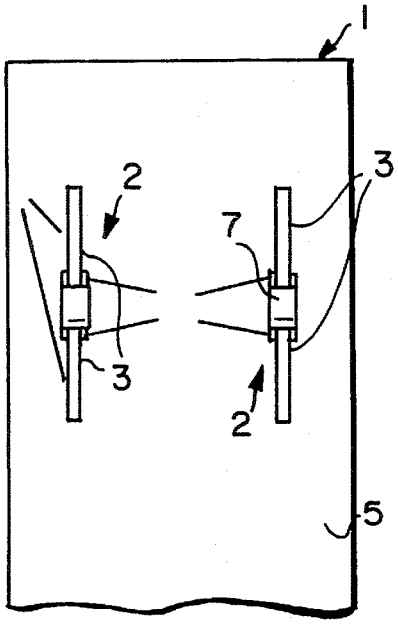
FIG. 10 A (PRIOR ART)
Figure 10B:
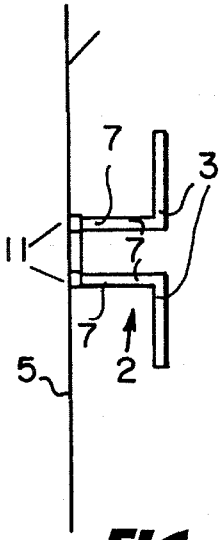
FIG. 10 B (PRIOR ART)
Figure 10C:
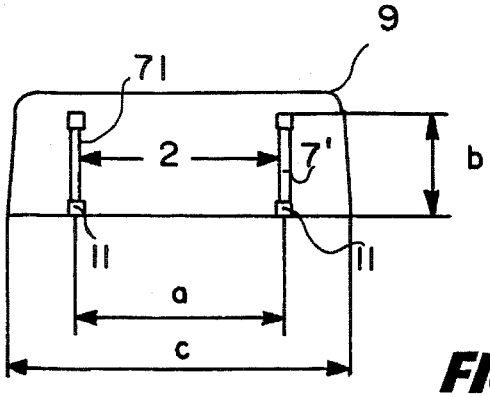
FIG. 10 C (PRIOR ART)

The directional antenna shown in FIGS. 10*a*–10*c* includes a dipole field 1, with two dipoles 3, for example, which are disposed in front of and spaced apart from a conducting flat or shaped reflector 5. In the example shown, the array accordingly includes two radiators 2, which are oriented parallel to one another and spaced apart by the distance a and are disposed in front of the reflector wall by a preliminary offset b.

The two dipoles 3 shown in FIGS. 10*a*–10*c* are held on the reflector 5 and secured by means of a so-called symmetrizer or balancer 7, which typically comprises two retention rods 7' that extend vertically to the reflector wall 5 and carry the dipoles 3.

The entire array is typically accommodated in protected fashion in a so-called radome 9, or in other words a so-called protective housing.

The radiation diagram in the E and H planes of a dipole field is determined essentially by the shaping and mechanical dimensions of the reflector and by the number and disposition of the dipoles.

In order to attain various directional characteristics, for instance in the known dipole antenna shown in FIGS. 10*a*–10*c*, both the reflector width c, in other words the width of the reflector wall 5, and the spacings a for the lateral offset transverse to the parallel-aligned dipoles 3 and the spacing b for the dipoles from the reflector 5 can all be varied.

For present-day mobile radio networks, directional antennas with vertical polarization are used, which have a horizontal directional characteristic of approximately 60° to 120° at the 3 dB point. These values can be achieved with one or two radiators in the array shown. However, the array comprising the dipoles 3, the symmetrizer loop 7 and including the connecting point 11 of the symmetrizer loop with the reflector 5, i.e. what is known as the base 11, and the preliminary offset must be optimized for each desired lobe width.

This means that when an antenna family is embodied in accordance with the desired lobe width, different radiators and various positionings on the reflector are required.

The described dipole antennas known from the prior art each include a plurality of individual parts, which must then be joined mechanically to one another. This is done by conventional joining methods, such as screwing, welding and soldering. The individual components for the dipole rods, the symmetrizer loop and the connecting points 11 for securing to the reflector may be tubular, generally flat, or shaped in some other way, depending on requirements. The individual parts are produced with the usual production tolerances. This is equally true for the structural unit in the assembled state, Attention must be paid to the fact that the tolerances dictated by production conditions also affect the electrical properties (such as VSWR) of the individual radiator, and in a multi-radiator array they affect the impedance of the entire antenna.

For mass production in particular, this means that close tolerances must be adhered to, both for the individual parts and for the structural units.

When the individual parts are put together, it must also be remembered that mechanical connecting points can also have effects that retroactively affect the antenna function. If in fact a plurality of HF carrier frequencies are applied simultaneously to the various connecting points of the individual parts, they can mix with nonlinearities and produce intermodulation products that have a deleterious effect on the operation of a mobile radio network. This effect can be further aggravated by contact corrosion, if there is an unfavorable pairing of materials and over a long service life.

A generic dipole array has been disclosed by German Utility Model DE 91 04 722 U1. In order to provide simplification in terms of the structural layout of a dipole and to reduce both the production cost and the expense for materials, this reference proposes that the dipole halves and the support struts that carry the dipole halves, or in other words the entire symmetrizer, be produced as a unitary stamped and bent part from sheet metal, preferably sheet aluminum. To that end, the dipole halves are U- shaped and are open toward the reflector. According to this reference, adequate rigidification of the support struts is said to be attained by suitable sheet-metal deforming operations, such as embossing, beading, edging, etc.

At the base, the support struts are provided with suitable bores, so that the thus-produced dipole can be screwed to the reflector.

The dipole is mounted on the reflector by means of screws. To that end, bores are made at the base of the support struts, through which the aforementioned screws are passed in order to firmly mount the dipole to the reflector and where the screws can be tightened on the reflector. However, this mechanical connection has the disadvantages referred to above.

The object of the present invention is therefore to overcome the disadvantages of the prior art and to create a directional antenna, in particular a dipole antenna, is comparatively simple to produce compared with the prior art and which moreover has improved electrical properties.

The object is attained in accordance with the invention by the characteristics recited in the body of claim 1. Advantageous features of the invention are recited in the dependent claims.

With surprisingly simple means, marked improvements over the prior art are attained by the present invention.

First, it is provided according to the invention that the dipoles of the dipole antenna, including the so-called symmetrizer loop or in other words the retaining struts for the dipoles, are cutout, for instance stamped out, of the material of the reflector wall, leaving only one electrically conductive connecting point with the remaining material of the reflector wall. The dipole antenna is then produced solely by unfolding the radiator including the dipole, or in other words folding it out or edging it, forming the so-called base at the connecting point from the radiator to the reflector wall. It is no longer necessary to put together various individual parts, a process that is complicated and time-consuming and presents problems in terms of tolerances that must be adhered to.

The contour cuts can be reproduced exactly, to close tolerances, using high-precision tools, for instance in the form of a computer-controlled laser or a numerical-control stamping tool. The radiator and reflector are of identical material. As a result, even potential contact corrosion can above all already be averted.

Above all, however, it is especially advantageous that there are no mechanical connecting points at which the disadvantages described for the prior art could arise.

The alignment of the radiator relative to the plane of the reflector can be accomplished at various angles. This enables problem-free adaptation to a desired dipole field, on the one hand, and on the other makes an especially flat design possible. Merely by means of various bending angles, directional diagrams with lobe widths of approximately 60° to 120° can be achieved.

In a preferred embodiment of the invention, a very flat design of a dipole antenna of this kind can be achieved. Because of the V-shaped course of the symmetrizing, an electrical length of approximately lambda/4 is attained, even though the dipole is spaced apart from the reflector by approximately lambda/8, for instance.

Since the base of the radiator changes, continuously conductively, into the reflector, this design principle is especially suitable for stripline-type power supply.

Further advantages of the invention reside in the manifold possibilities for power suppy.

For instance, power suppy can be done with coaxial cables or with a stripline, and one-half of the symmetrizing loop and of the reflector can be used as an external conductor.

Figure 1A:
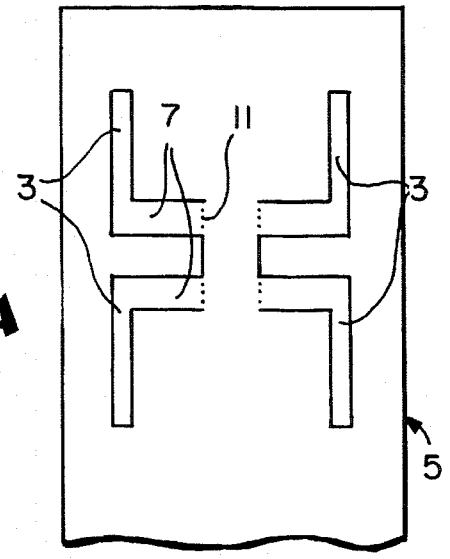
Figure 1B:
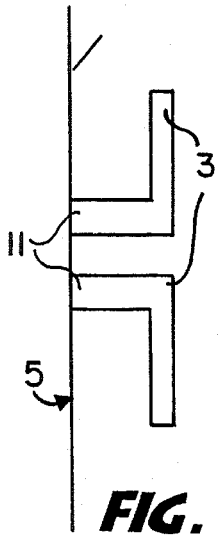
Figure 1C:
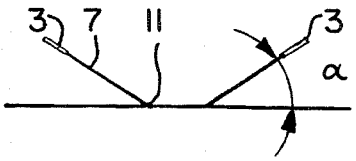
Figure 1D:
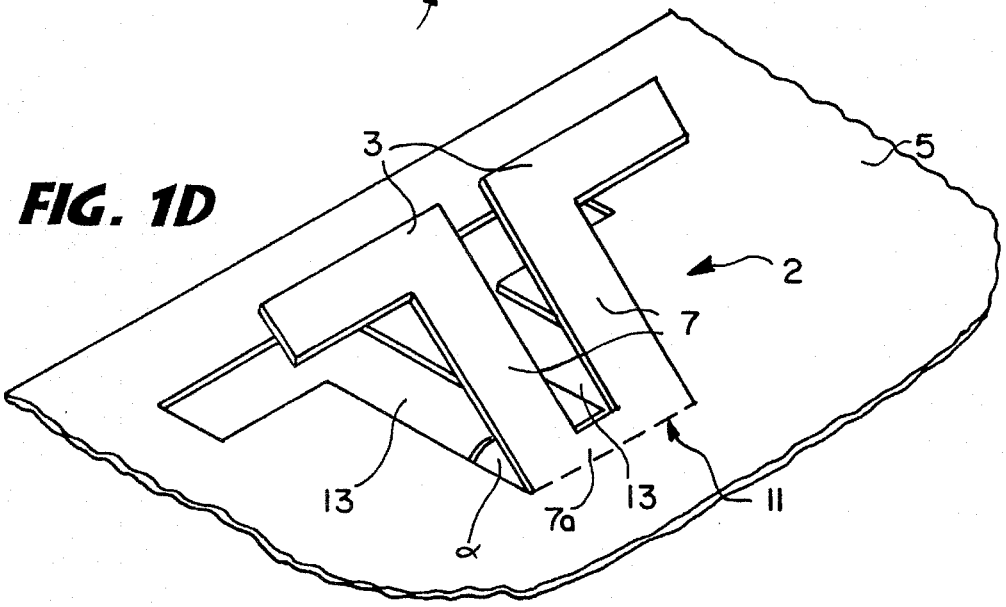
Figure 2:
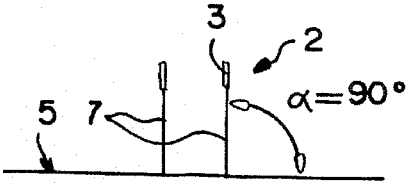
Figure 3:
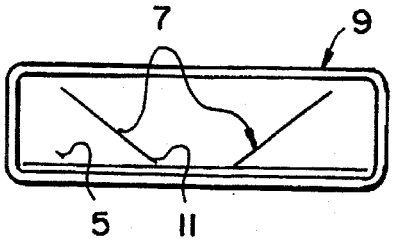
Figure 4A:
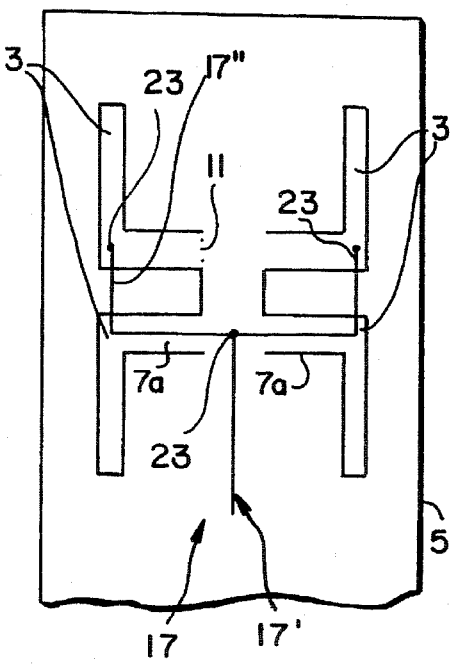
Figure 4B:
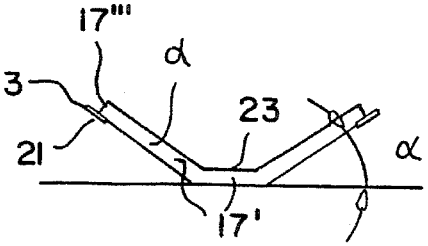
Figure 5:
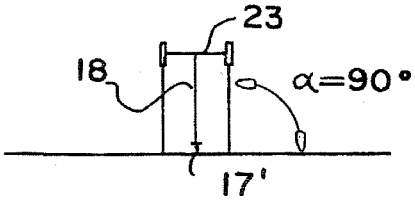

Other advantages, details and characteristics of the invention will become apparent from the exemplary embodiments described in conjunction with drawings. Individually, the drawings show:

FIGS. 1*a*–1*c*: a schematic plan view, longitudinal side view and transverse side view, respectively, of a first exemplary embodiment of the invention;

FIG. 1*d*: a simplified perspective view of a detail of a radiator folded out of the reflector;

FIG. 2: a transverse side or end-on view of a radiator extending with an alignment at a different angle relative to the reflector wall;

FIG. 3: a further transverse side or end-on view of a dipole antenna accommodated in a closed radome;

FIGS. 4*a* and 4*b*: a schematic plan view and transverse side view on a dipole antenna including power suppy to the dipoles by the stripline technique;

FIG. 5: a transverse side or end-on view of an exemplary embodiment of a dipole antenna that is modified over FIG. 4*b;*

Figure 6A:
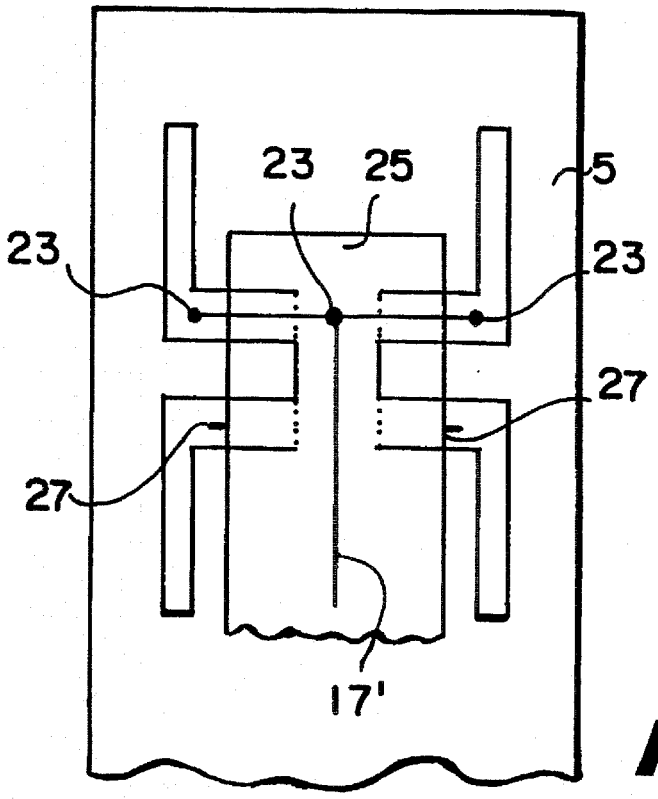
Figure 6B:
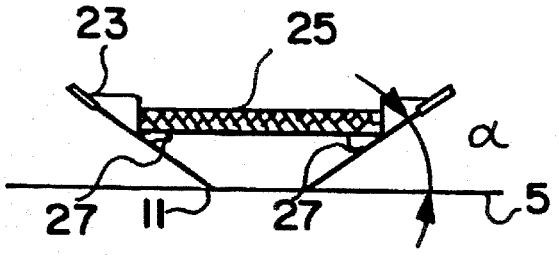
Figure 7:
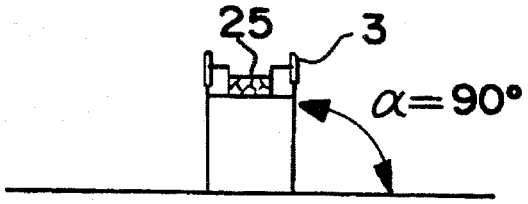

FIGS. 6*a* and 6*b*: a plan view and a transverse side or end-on view of a dipole antenna with power suppy to the dipoles by the stripline technique with a carrier substrate;

FIG. 7: a transverse side or end-on view of a dipole antenna that is modified compared with FIG. 6*b;*

Figure 8A:
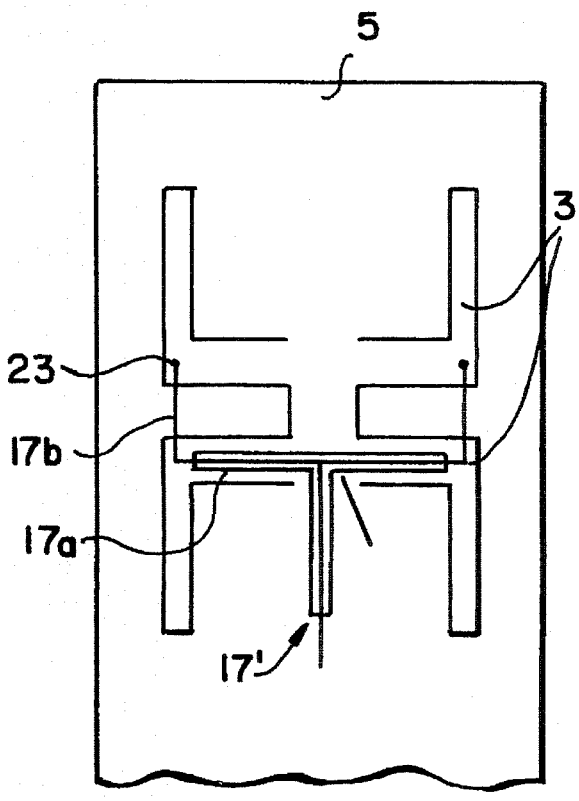
Figure 8B:
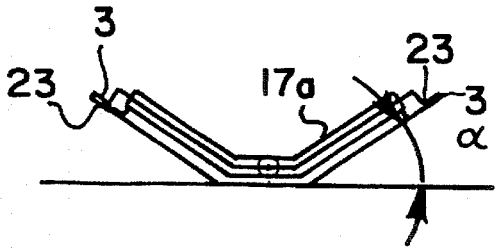
Figure 9:
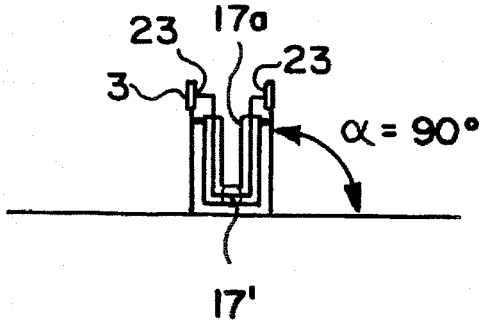

FIGS. 8*a* and 8*b*: a plan view and a transverse side or end-on view of a dipole antenna with power suppy to the dipoles by the coaxial technique;

FIG. 9: a transverse side or end-on view of a dipole modified over FIG. 8*b;*

FIGS. 10*a*–10*c*: a plan view, longitudinal side view and transverse side view, respectively, of a dipole antenna according to the prior art.

In FIGS. 1*a*–1*d*, a first exemplary embodiment of the invention for a directional antenna, in other words a dipole antenna, with two dipoles is shown.

As can be seen from the schematic perspective view of FIG. 1*d*, the essentially L-shaped form of a dipole 3, with the symmetrizer 7 associated with the respective two parts of the dipole, is stamped out of the material of the reflector 5, for instance by means of a computer-controlled laser or a numerical- control stamping tool, and deployed at the connecting point 11 with the reflector wall, or in other words at the base, by bending or edging along the desired bending angle α. By way of example, in the exemplary embodiment, the angle α of FIGS. 1*a*–1*d* is approximately 30° to 60°.

In FIG. 1*d*, an opening 13 is thereby left behind in the reflector field 5 in the region that was stamped out, but for the transmission and reception function of the directional antenna in general this need not necessarily be disadvantageous in principle and may even have advantages. By suitable dimensioning of the stamped-out portion that takes the form of the opening 13, the front-to-back ratio of the dipole field can be varied.

However, if needed, the opening 13 can easily be closed with electrically conductive material, for instance by adhesively attaching a metal foil, and the metal foil may be provided with a metal layer on its back side, without causing a galvanic contact with the sheet metal of the reflector on top of it.

By varying the spacing between the two dipoles and by varying the bending angle and thus the spacing of the dipoles 3 from the plane of the reflector 5, a defined horizontal radiation diagram can be established, In other words, adaptation of the radiation diagram can be enabled solely by varying the bending angle α.

Moreover, if needed, the production of a directional antenna with other geometrical dimensions, or in other words a different magnitude for the spacing a between the dipoles and a different length of the dipoles can be enabled merely by varying the desired data in the computer-controlled laser or by changing the stamping tool.

For the sake of simplicity, in the plan view of FIG. 1*a*, the opening 13 created in the reflector 5 intrinsically by the cutting out or stamping out operation has not been shown. For it, reference is made to the detail shown in FIG. 1*d*.

As can be seen from FIG. 1*d*, the symmetrizer loop 7, or in other words specifically the two parallel-extending band-like or striplike halves of the symmetrizer loop 7, may be embodied with a lower wall segment 7*a* that joins these two halves. This creates the possibility, after suitable stamping or cutting out of the dipoles 3 with the symmetrizer loop 7, of bending them out around the common bending line 11 relative to the plane of the reflector 5. In a departure from this—as shown in the other drawing figures, which are shown only schematically—the two halves of the symmetrizer loop 7 may be stamped out individually and each bent relative to the plane of the reflector 5 via a separate bending line 11 located at the base and then deployed (this is suggested by dotted lines in FIG. 1, for instance). In that case, the bending line 11 is flush with the cutting or stamping line that extends transversely between the two halves of the symmetrizer loop 7 and is located in the plane of the reflector, if such a cutting or stamping line is in fact made and provided at all.

In a departure from FIG. 1*c*, FIG. 2 in a transverse side or end-on view of the dipole antenna shows the alignment of the symmetrizer loop for a bending angle α of 90°, that is, at right angles to the plane of the reflector wall.

FIG. 3 shows that in principle the dipole antenna according to the invention is likewise disposed in a closed radome 9 acting as a protective housing.

The exemplary embodiment of FIGS. 4*a* and 4*b* and of FIG. 5 is essentially equivalent to the exemplary embodiment of FIGS. 1*a*–1*d* and FIG. 2, respectively. In FIGS. 4*a*, 4*b* and 5, one possible way of supplying power to the dipole using a stripline 17 is shown in principle. One half 7a of the symmetrizer loop 7 and the reflector are used as an external conductor.

The terminal conductor 17' is laid for instance in parallel alignment with the dipoles 3, in the middle between them, a slight distance above the sheet-metal reflector 5 representing the external conductor. The stripline 17' then branches off at a branching point 23 between the two halves 7*a*, oriented toward one another, of the respective symmetrizer 7. The line extends at a slight, uniform distance d above the associated half 7*a* of the symmetrizer 7, or in other words preferentially with the same angle α from the plane of the reflector. An angled conductor segment 17" then follows at the transition from one half 7*a* of the symmetrizer 7 to the respective associated part of the dipole 3; at the adjacent transition from the other half of the symmetrizer 7 to the associated part of the dipole, this segment 17" changes into an angled conductor segment 17''' that extends toward this connection point. This defines the actual power suppy point 23.

In the case of the exemplary embodiment of FIG. 5, for a bending angle α=90°, the branching point 23 is located approximately at the level of the opposed dipoles 3 of the two radiators 2. From the terminal side 17', laid a slight distance above and parallel to the reflector 5, a vertical intermediate line 18 here extends in parallel alignment between the two halves of the symmetrizer 7 to the raised branching point 23.

The angular course of the striplines 17" and 17''', in the exemplary embodiment of FIG. 5 as well, is effected in principle similarly to the way described in conjunction with FIGS. 4*a* and 4*b*.

In the exemplary embodiment described hereinafter in conjunction with FIGS. 6*a* and 6*b* and 7, power supply to the dipoles 3 is likewise by the stripline technique, specifically using a carrier substrate 25.

Particularly in the case of a bending angle α of less than 90°, the carrier substrate 25 is anchored (for instance via an insulating fixation 27 made of plastic), resting mechanically between the two opposed symmetrizers 7 of the two dipoles 3 shown in the drawings. The stripline 17 with the terminal conductor 17' is formed on this carrier substrate 25, and from its branching point 23 the terminal lines 17' then lead to the respective power suppy points of the two dipoles 3.

At a bending angle α of 90° (FIG. 7) or less, the carrier substrate 25 may also be mounted extending at a greater distance from the reflector wall 5, for instance at least approximately at the level of the dipoles 3 or slightly below them, by means of the fixation 27.

The exemplary embodiments of FIGS. 8*a*, 8*b* and 9 illustrate the instance in which the dipoles 3 are supplied with power via coaxial cable. The course of the lines is essentially equivalent to the exemplary embodiment in stripline technology of FIGS. 4*a*, 4*b* and 5; here, the outer conductors 17*a* of the two coaxial terminal conductors 17' end approximately at the level of the dipoles, and the outer conductors 17*a* are here connected conductively separately to the respective half 7*a* of the symmetrizer 7, while the inner conductor 17*b*, via the following conductor segments 17" and 17''', leads to the respective power suppy point 23 at the transition from the other half of the symmetrizer 7 to the associated part of the dipole 3 that begins there.

We claim:

1. A direction antenna having at least one radiator in the form of a dipole including an associated symmetrizer that carries the dipole above which the at least one dipole is mounted on a reflector, wherein a respective dipole half is embodied in one piece with the associated part of the symmetrizer, characterized in that the dipole, including its symmetrizer, is produced from the material of the reflector, in that the dipole and the symmetrizer are cut out from the remaining material of the reflector except for a connecting segment by means of a cutting operation and that the symmetrizer is bent out at an angle α relative to the reflector.

2. The directional antenna of claim 1, characterized in that the symmetrizer is bent out relative to the plane of the remaining material of the reflector in the region of the connecting segment.

3. The directional antenna of claim 1, characterized in that the bending angle α is 90°.

4. The directional antenna of claim 1, characterized in that the bending angle α is 65° and less.

5. The directional antenna of claim 4, characterized in that the bending angle α is less than 45°.

6. The directional antenna of claim 1, characterized in that an opening in the material of the reflector created in the region of the cut-out radiator is covered by an electrically conductive layer.

7. The directional antenna of claim 6, characterized in that the electrically conductive layer comprises a metal foil.

8. The directional antenna of claim 7, characterized in that the metal foil is provided with the electrically conductive metal layer on its surface remote from the material of the reflector.

9. The directional antenna of claim 1, characterized in that the directional characteristic of the dipole antenna is variable by varying the bending angle (α).

10. The directional antenna of claim 1, characterized in that it comprises a plurality of dipoles and as a whole is embodied in one piece.

11. The directional antenna of claim 1, characterized in that the dipoles are supplied with power by means of a stripline, and one half of the symmetrizer of a dipole and the reflector are used as external conductors.

12. The directional antenna of claim 11, characterized in that the stripline extends a slight distance (d) above the reflector and above the respective half of the symmetrizer.

13. The directional antenna of claim 11, characterized in that the dipoles are supplied with power by means of a stripline extending on a carrier substrate.

14. The directional antenna of claim 13, characterized in that the carrier substrate for the stripline (17), by means of an insulating fixation, is disposed on the dipoles with lateral offset transversely to the plane of the reflector.

15. The directional antenna of one of claims 1–10, characterized in that the dipoles are supplied with power by coaxial cables.

16. The directional antenna of one of claims 1–14 characterized in that the spacing between the dipoles and the reflector is at least 10% and less than about 50% of the electrical wavelength.

* * * * *